US011404236B2

(12) United States Patent
Song et al.

(10) Patent No.: US 11,404,236 B2
(45) Date of Patent: Aug. 2, 2022

(54) X-RAY TUBE

(71) Applicant: ELECTRONICS AND TELECOMMUNICATIONS RESEARCH INSTITUTE, Daejeon (KR)

(72) Inventors: Yoon-Ho Song, Daejeon (KR); Jun-Tae Kang, Daejeon (KR); Jin-Woo Jeong, Daejeon (KR); Jae-Woo Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 17/108,634

(22) Filed: Dec. 1, 2020

(65) Prior Publication Data

US 2021/0166909 A1 Jun. 3, 2021

(30) Foreign Application Priority Data

Dec. 3, 2019 (KR) ..... 10-2019-0159316
Nov. 30, 2020 (KR) ..... 10-2020-0163945

(51) Int. Cl.

| | |
|---|---|
| ***H01J 35/16*** | (2006.01) |
| ***H01J 35/06*** | (2006.01) |
| ***H01J 35/14*** | (2006.01) |
| ***H01J 35/04*** | (2006.01) |

(52) U.S. Cl.

CPC ..... *H01J 35/16* (2013.01); *H01J 35/045* (2013.01); *H01J 35/064* (2019.05); *H01J 35/14* (2013.01)

(58) Field of Classification Search

CPC ..... H01J 35/16; H01J 35/045; H01J 35/064; H01J 35/14

See application file for complete search history.

(56) References Cited

U.S. PATENT DOCUMENTS

| | | | | |
|---|---|---|---|---|
| 7,236,568 | B2 | 6/2007 | Dinsmore et al. | |
| 2005/0213709 | A1 | 9/2005 | Dinsmore et al. | |
| 2013/0129046 | A1* | 5/2013 | Yamazaki | H01J 35/16 378/62 |
| 2014/0161232 | A1 | 6/2014 | Jeong et al. | |
| 2014/0177796 | A1* | 6/2014 | Sato | H01J 35/16 378/62 |
| 2016/0086761 | A1 | 3/2016 | Yanagisawa et al. | |
| 2017/0053771 | A1* | 2/2017 | Jeong | H01J 35/045 |
| 2018/0247787 | A1* | 8/2018 | Jeong | H01J 35/16 |

FOREIGN PATENT DOCUMENTS

KR 10-2017-0022852 A 3/2017

* cited by examiner

*Primary Examiner* — Chih-Cheng Kao
(74) *Attorney, Agent, or Firm* — Rabin & Berdo, P.C.

(57) ABSTRACT

Provided is an X-ray tube. The X-ray tube includes a cathode electrode, an anode electrode vertically spaced apart from the cathode electrode, an emitter on the cathode electrode, a gate electrode disposed between the cathode electrode and the anode electrode, the gate electrode including an opening at a position corresponding to the emitter, and a spacer provided between the gate electrode and the anode electrode. The spacer includes an insulator and conductive dopants doped in the insulator.

18 Claims, 11 Drawing Sheets

X-RAY TUBE

CROSS-REFERENCE TO RELATED APPLICATIONS

This U.S. non-provisional patent application claims priority under 35 U.S.C. § 119 of Korean Patent Application No. 10-2019-0159316, filed on Dec. 3, 2019, and 10-2020-0163945, filed on Nov. 30, 2020 the entire contents of which are hereby incorporated by reference.

BACKGROUND

The present disclosure relates to an X-ray tube.

An X-ray tube generates X-rays by generating electrons inside a vacuum container and accelerating the electrons in a direction of an anode electrode to which a high voltage is applied to collide with a metal target on the anode electrode. Here, a voltage difference between the anode electrode and a cathode electrode is defined as an acceleration voltage that accelerates the electrons. The electrons are accelerated with an acceleration voltage of several kV to several hundreds kV depending on the use of the X-ray tube. A gate electrode or the like is provided between the anode electrode and the cathode electrode.

SUMMARY

The present disclosure provides a structure of an X-ray tube that is stably driven even at a high voltage.

An embodiment of the inventive concept provides an X-ray tube including: a cathode electrode;

an anode electrode vertically spaced apart from the cathode electrode; an emitter on the cathode electrode; a gate electrode disposed between the cathode electrode and the anode electrode, the gate electrode including an opening at a position corresponding to the emitter; and a spacer provided between the gate electrode and the anode electrode, wherein the spacer includes an insulator and conductive dopants doped in the insulator.

In an embodiment, the spacer may have a volume resistivity of about $10^9$ Ω·cm or more and less than about $10^{13}$ Ω·cm.

In an embodiment, the insulator may include aluminum oxide ($Al_2O_3$), and the conductive dopants may include titanium dioxide ($TiO_2$).

In an embodiment, the spacer may include more than about 1.64 wt % and less than about 2.44 wt % of the conductive dopants.

In an embodiment, the insulator may include first metal oxide having a resistivity of about $10^{13}$ Ω·cm or more, and the conductive dopants may include second metal oxide having a resistivity of about $10^8$ Ω·cm or less.

In an embodiment, a voltage applied to the anode electrode may be about 70 kV or more.

In an embodiment, the gate electrode may further include a protrusion extending toward the anode electrode.

In an embodiment, the spacer may include more than about 1.64 wt % and less than about 2.44 wt % of titanium oxide ($Ti_xO_y$, x=1 to 3, y=1 to 3).

In an embodiment, the spacer may include about 93 wt % to about 96 wt % of aluminum oxide.

In an embodiment of the inventive concept, an X-ray tube includes: a cathode electrode; an anode electrode vertically spaced apart from the cathode electrode; a target disposed on one surface of the anode electrode, wherein the one surface of the anode electrode faces the cathode electrode; an emitter on the cathode electrode; a gate electrode disposed between the cathode electrode and the anode electrode, the gate electrode including an opening at a position corresponding to the emitter; and a spacer provided between the gate electrode and the anode electrode, wherein the spacer includes first and second regions between the gate electrode and the anode electrode and a third region between the first and second regions, wherein the first region is adjacent to the gate electrode, the second region is adjacent to the anode electrode, each of the first to third regions comprises an insulator, and each of the first and second regions further comprises conductive dopants doped in the insulator.

In an embodiment, each of a volume resistivity of the first region and a volume resistivity of the second region may be less than a volume resistivity of the third region.

In an embodiment, each of the first region and the second region may have a volume resistivity of about $10^6$ Ω·cm or more and less than about $10^9$ Ω·cm, and and wherein the third region has a volume resistivity of about $10^{13}$ Ω·cm or more.

In an embodiment, each of the first region and the second region may include about 3 wt % or more of conductive dopants.

In an embodiment, the third region may further include conductive dopants in the insulator; the first region may have a concentration of the conductive dopants, which decreases in a first direction from the cathode electrode toward the anode electrode, the second region has a concentration of the conductive dopants, which increases in the first direction, and the third region may have a concentration of the conductive dopants, which decreases and then increases in the first direction.

In an embodiment, each of a first length of the first region in a first direction from the cathode electrode toward the anode electrode and a second length of the second region in the first direction may be less than a third length of the third region in the first direction.

In an embodiment, a sum of a volume of the first region and a volume of the second region may be less than a volume of the third region.

In an embodiment, a level of the uppermost portion of the first region may be higher than a level of the uppermost portion of the gate electrode, and a level of the lowermost portion of the second region may be lower than a level of the lowermost portion of the anode electrode.

In an embodiment, the X-ray tube may further include at least one focusing electrode between the gate electrode and the anode electrode, wherein the level of the uppermost portion of the first region may be higher than a level of the uppermost portion of the focusing electrode.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Exemplary embodiments of the present invention will be described with reference to the accompanying drawings so as to sufficiently understand constitutions and effects of the present invention. The present disclosure may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims. In the accompanying drawings, the components are shown enlarged for the sake of convenience of explanation, and the proportions of the components may be exaggerated or reduced for clarity of illustration.

Unless terms used in embodiments of the present invention are differently defined, the terms may be construed as meanings that are commonly known to a person skilled in the art. Hereinafter, the present disclosure will be described in detail by explaining preferred embodiments of the invention with reference to the accompanying drawings.

Embodiment 1

Figure 1A:
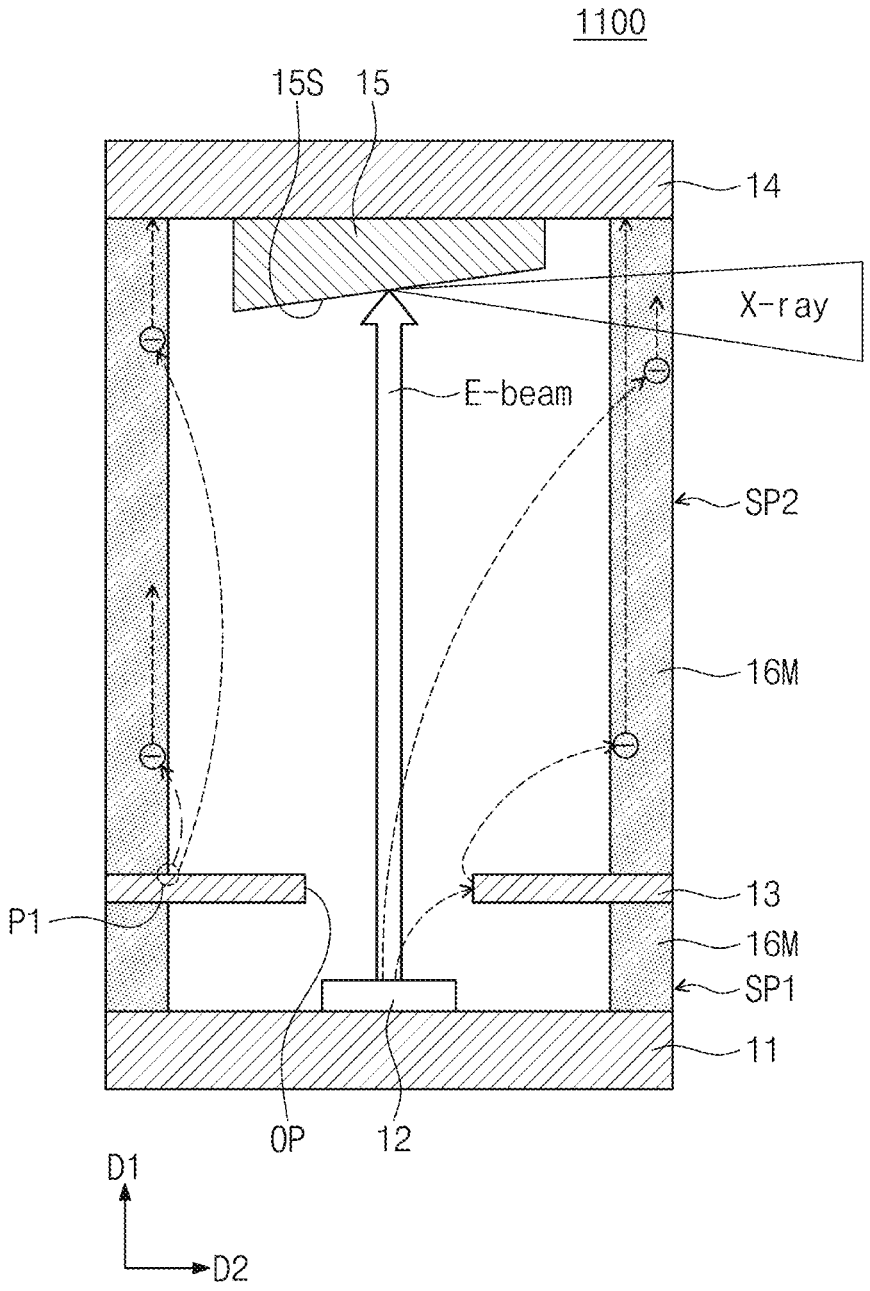
FIG. 1A is a cross-sectional view illustrating a structure of an X-ray tube according to the inventive concept.

FIG. 1A is a cross-sectional view illustrating a structure of an X-ray tube according to an embodiment of the inventive concept.

Referring to FIG. 1A, an X-ray tube 1100 according to an embodiment of the inventive concept may include a cathode electrode 11, an emitter 12, an anode electrode 14, a target 15, a gate electrode 13, a first spacer SP1, and a second spacer SP2.

The cathode electrode 11 and the anode electrode 14 are disposed to face each other and may be spaced apart in a first direction D1. In this specification, the first direction D1 represents a direction perpendicular to a top surface of the cathode electrode 11. Alternatively, the first direction D1 refers to a direction from the cathode electrode 11 toward the anode electrode 14. A second direction D2 represents a direction parallel to the top surface of the cathode electrode 11.

The cathode electrode 11, the anode electrode 14, and the gate electrode 13 may be electrically connected to an external power source (not shown). For example, a positive voltage or a negative voltage may be applied to the cathode electrode 11 or may be connected to a ground power source. A voltage having a potential higher than that of the cathode electrode 11 may be applied to the anode electrode 14 and the gate electrode 13.

Each of the anode electrode 14, the cathode electrode 11, and the gate electrode 13 may include a conductive material. For example, the conductive material may include a metal material such as copper (Cu), aluminum (Al), molybdenum (Mo), and the like. The anode electrode 14 may be a rotatable anode electrode rotating in one direction or a fixed anode electrode.

The gate electrode 13 may be disposed between the emitter 12 and the anode electrode 14. The gate electrode 13 may be disposed adjacent to the emitter 12 rather than the anode electrode 14. The gate electrode 13 may be disposed above the cathode electrode 11 and may include an opening OP at a position corresponding to the emitter 12. When a plurality of emitters are disposed on the cathode electrode 11, the gate electrode 13 may include a plurality of openings OP. For example, the gate electrode 13 may have a mesh shape.

The emitter 12 may include, for example, a carbon nanotube. The emitter 12 may be arranged in the form of a dot array or may have a shape of yarn formed by twisting carbon nanotubes.

The target 15 may be provided below the anode electrode 14. A lower surface of the target 15, i.e., a surface 15S facing the cathode electrode 11 may be tilted. The target 60 may include, for example, at least one of molybdenum (Mo), tantalum (Ta), tungsten (W), copper (Cu), or gold (Au).

The electron beam (E-beam) emitted from the emitter 12 may be generated and accelerated in a vacuum state. The E-beam emitted from the emitter 12 may pass through the opening OP of the gate electrode 13 so as to be focused onto the target 15. The electron beam collides with the target 15 to generate x-rays.

In order to generate the vacuum state, the X-ray tube 1000 may be manufactured in a completely sealed state. Alternatively, according to the manufacturing method, the inside of the X-ray tube 1000 may be in a vacuum state through a vacuum pump (not shown) connected to the outside.

Each of the first spacer SP1 and the second spacer SP2 may have a tube shape. The first spacer SP1 may be disposed between the cathode electrode 11 and the gate electrode 13. The second spacer SP2 may be disposed between the gate electrode 13 and the anode electrode 14.

Each of the first spacer SP1 and the second spacer SP2 may include a solid material even in a vacuum state. The first spacer SP1 may include one of a high-resistance insulator, a medium-resistance insulator, and a low-resistance insulator to be described later. For example, the first spacer SP1 may include a medium-resistance insulator 16M.

The second spacer SP2 may include the medium-resistance insulator 16M. In this specification, the low-resistance insulator, medium-resistance insulator, and high-resistance insulator may be defined according to an intensity of a volume resistivity (or resistivity).

The low-resistance insulator may be defined as a material having a resistivity of about $10^6$ Ω·cm to about $10^9$ Ω·cm, the medium-resistance insulator may be defined as a materials having a resistivity of about $10^9$ Ω·cm to about $10^{13}$ Ω·cm, and the high-resistance insulator may be defined as a material having a resistivity of $10^{13}$ Ω·cm or more.

The second spacer SP2 may include an insulator and conductive dopants dispersed in the insulator. The conductive dopant may be uniformly distributed within the insulator. Characteristics of the medium-resistance insulator 16M of the second spacer SP2 may be provided by doping conductive dopants into the insulator at a predetermined ratio. For example, the insulator may be contained at a ratio of about 93 wt % to about 96 wt % in the second spacer SP2. An amount of conductive dopants in the second spacer SP2 may range of about 1.64 wt % to about 2.44 wt %. The second spacer SP2 may further include an additive and other impurities. A total amount of additive in the second spacer SP2 may range of about 1 wt % to about 4 wt %. A total amount of impurities in the second spacer SP2 may be less than about 2 wt %.

The insulator may include first metal oxide, and the conductive dopants may include second metal oxide. The second metal oxide may have a resistivity less than that of the first metal oxide. For example, the first metal oxide may include aluminum oxide ($Al_2O_3$), and the second metal oxide may include titanium oxide ($Ti_xO_y$, x=1 to 3, y=1 to 3). For example, the second metal oxide may include at least one of $TiO_2$, $Ti_2O_3$, or TiO. For another example, the second metal oxide may include chromium oxide ($Cr_2O_3$).

The additive may include a material such as silicon oxide ($SiO_2$) and manganese dioxide ($MnO_2$), which improve rigidity of the second spacer SP2 and adhesion to electrodes during a brazing process to be described later. The impurities may include carbon and other oxides.

The aluminum oxide may have a resistivity of about $10^{14}$ Ω·cm, and the titanium dioxide ($TiO_2$) may have a resistivity equal to or less than about $10^9$ Ω·cm. $Ti_2O_3$ may have a resistivity equal to or less than about $10^{-1}$ Ω·cm, and TiO may have a resistivity equal to or less than about $10^{-4}$ Ω·cm.

Some electrons of the E-beam emitted from the emitter 12 may collide with the gate electrode 13 and thus be scattered. The scattered electrons may collide with the second spacer SP2. Some electrons of the E-beam may be deviated from a normal track to collide with the second spacer SP2.

Electrons other than the E-beam may be emitted at a triple point P1 under a high voltage condition. The triple point P1 may be a point at which the vacuum, the metal of the gate electrode 13, and the insulator of the second spacer SP2 meet each other, and also, electric fields are strongly applied, and electrons are emitted from the metal. The emitted electrons may collide with the second spacer SP2.

According to the inventive concept, even if the electrons collide with the second spacer SP2, the medium-resistance insulator 16M may have a certain level of low conductivity under the high voltage condition and thus may not generate separate secondary electrons after the collision. The electrons may move toward the anode electrode 14 through the second spacer SP2.

The second spacer SP2 according to the inventive concept is formed through the following method. For example, based on the total amount of aluminum oxide ($Al_2O_3$) insulator containing the additive, more than about 2 wt % and less than about 2.5 wt % of titanium dioxide ($TiO_2$) may be added and sintered. In a hydrogen gas atmosphere, high-temperature heat treatment may be performed to reduce the resistivity of the second spacer SP2. At least a portion of titanium dioxide ($TiO_2$) may be reduced in the hydrogen gas atmosphere to generate $Ti_2O_3$ and/or TiO.

Table 1 below shows electrical properties of an aluminum oxide ($Al_2O_3$) insulator when about 4 wt % of a titanium dioxide ($TiO_2$) dopant is added, and electrical properties after heat treatment for about 30 minutes at a temperature of about 1,300° C. in the hydrogen gas atmosphere.

TABLE 1

| | Electrical properties of insulator without conductive dopant added | Electrical properties of insulator with conductive dopant added | Electrical properties after heat treatment of conductive dopant-added insulator in hydrogen atmosphere |
|---|---|---|---|
| Surface resistance (Ω/sq) | | $2.2 \times 10^{15}$ | $3.0 \times 10^{8}$ |
| Volume resistance (Ω · cm) | $\sim 10^{14}$ | $9.25 \times 10^{13}$ | $6.0 \times 10^{7}$ |
| Electrical conductivity (S/cm) | | $1.12 \times 10^{-14}$ | $1.9 \times 10^{-8}$ |

Referring to Table 1, it is seen that the volume resistance decreases when the dopant is added to the insulator, and the volume resistance decreases further when the heat treatment is performed in the hydrogen atmosphere. Additionally, a metalizing process may be performed on a portion of the second spacer SP2, which is in contact with the anode electrode 14, and a portion of the second spacer SP2, which is in contact with the gate electrode 13. The adhesion between the second spacer SP2 and each of the anode electrode 14 and the gate electrode 13 in the vacuum state may increase through the metallization process (brazing bonding).

Embodiment 2

Figure 1B:
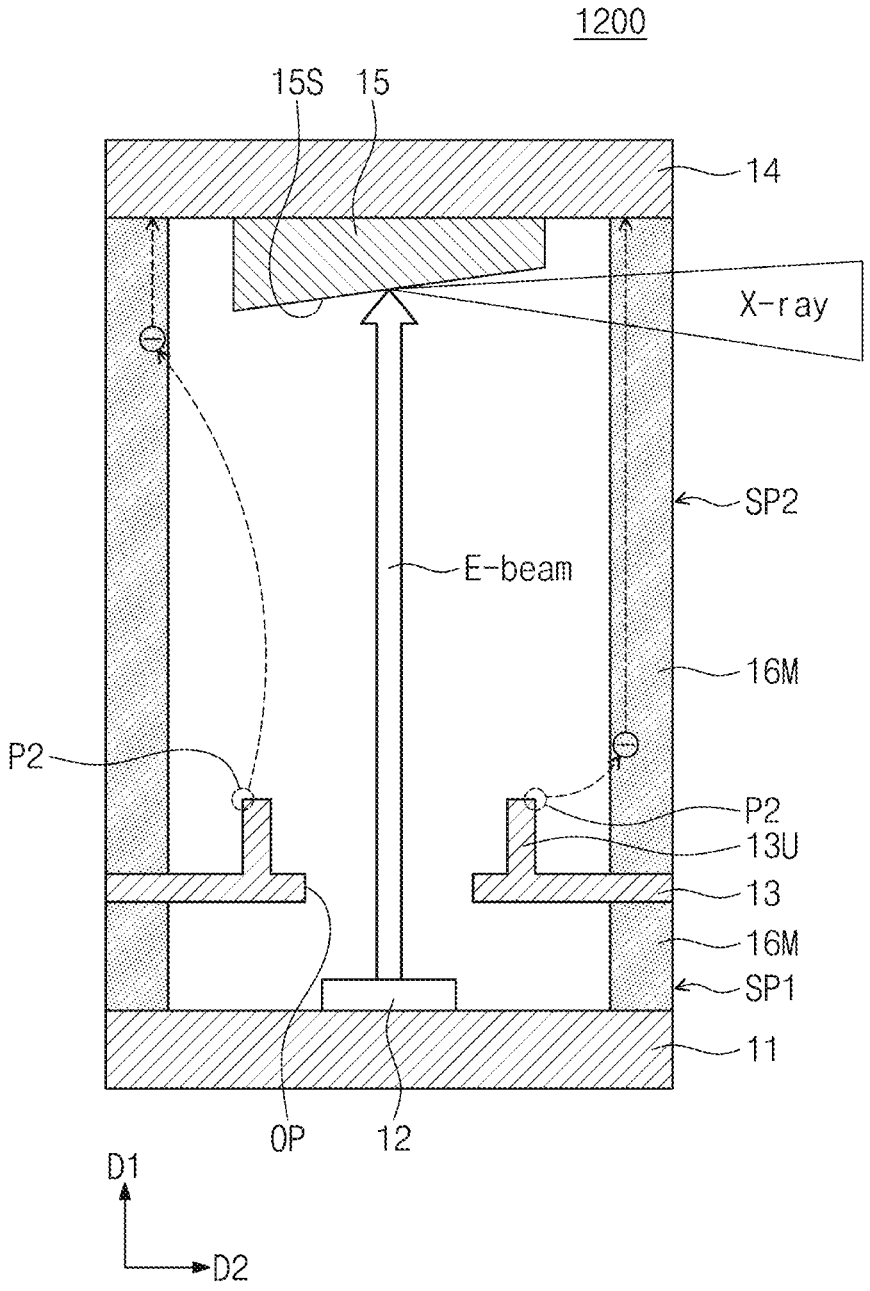
FIG. 1B is a cross-sectional view illustrating a structure of an X-ray tube according to Embodiment.

FIG. 1B is a cross-sectional view illustrating a structure of an X-ray tube according to Embodiment. Since the above-described contents have been described in FIG. 1A except for following contents to be described below, the duplicated contents will be omitted.

Referring to FIG. 1B, a gate electrode 13 may further include a protrusion 13U protruding from a periphery of an opening OP toward an anode electrode 14. The protrusion 13U may be spaced apart from a second spacer SP2 in the second direction D2. The protrusion 13U may serve to focus E-beam so that the E-beam passing through the opening OP is directed toward a target.

Under a high voltage condition, since electric fields are strongly applied at an edge P2 of the protrusion 13U, electrons other than the E-beam may be emitted. The emitted electrons may collide with the second spacer SP2. After the collision, the electrons may move toward the anode 14 without generating the separate secondary electrons.

COMPARATIVE EXAMPLE

Figure 2:
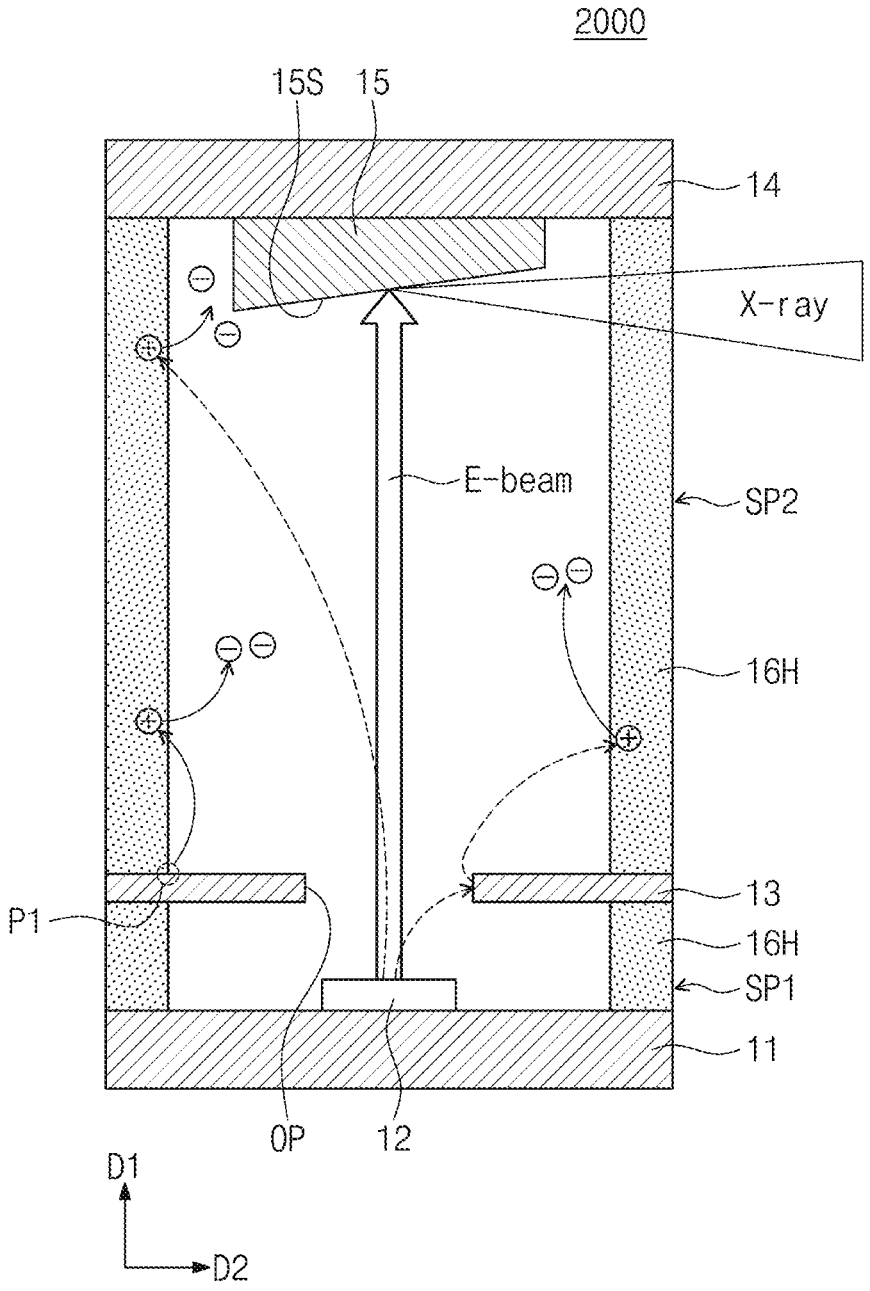
FIG. 2 is a cross-sectional view of an X-ray tube according to Comparative Example.

FIG. 2 is a cross-sectional view of an X-ray tube according to Comparative Example.

An X-ray tube 2000 according to Comparative Example may include a second spacer SP2 provided as a high-resistance insulator 16H. The high-resistance insulator 16H does not contain a conductive dopant. In the case of the existing inventions, in order to be stably driven even at a high acceleration voltage of about 70 kV or more (a voltage difference between an anode electrode and a cathode electrode), the existing second spacer SP2 may generally use the high-resistance insulator 16H.

Scattered electrons, electrons deviated from a normal track, and electrons emitted from a triple point P1 may collide with the second spacer SP2. Due to the collision, secondary electrons are generated, and the second spacer SP2 is charged with a positive charge (ex: a charging phenomenon) to cause a risk of an occurrence of arc.

Referring back to FIGS. 1A and 1B, in the X-ray tubes 1100 and 1200 according to the inventive concept, since the second spacer SP2 includes the medium-resistance insulator 16M, the electrons may move in a direction of the anode electrode 14 without generating the secondary electrons in spite of the collision with the electrons. In addition, the medium-resistance insulator 16M may reduce an intensity of electric fields near the triple point P1 and reduce electron emission at the triple point P1. Accordingly, since the X-ray tube according to the inventive concept may be stably driven even in the high voltage state to improve reliability.

Embodiment 3

Figure 3:
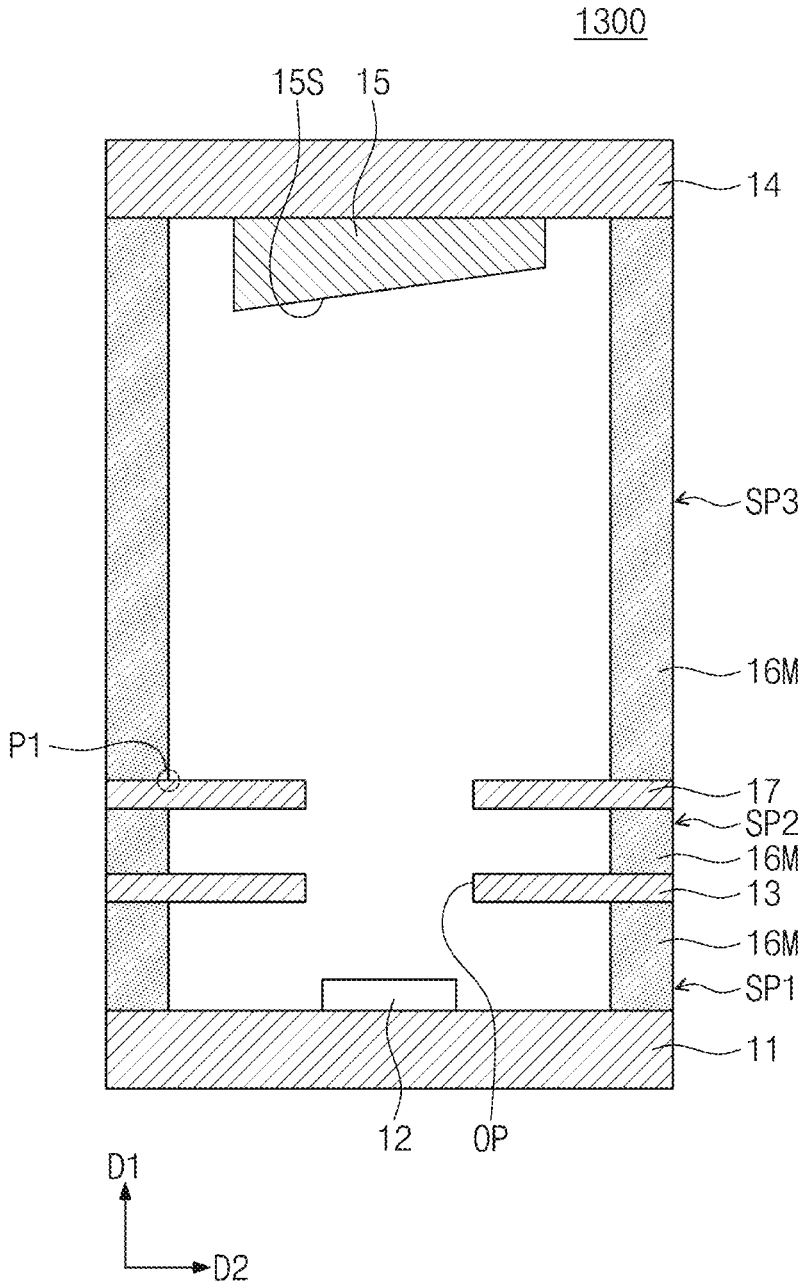
FIG. 3 is a cross-sectional view of an X-ray tube according to Embodiment.

FIG. 3 is a cross-sectional view of an X-ray tube according to Embodiment. Since the above-described contents have been described in FIG. 1 except for following contents to be described below, the duplicated contents will be omitted.

Referring to FIG. 3, an X-ray tube 1300 according to some embodiments may further include at least one focusing electrode 17.

The focusing electrode 17 may be disposed between a gate electrode 13 and an anode electrode 14. The focusing electrode 17 may be disposed adjacent to the gate electrode 13 rather than the anode electrode 14. The focusing electrode 17 may have a shape similar to that of the gate electrode 13.

The X-ray tube 1300 may include a first spacer SP1, a second spacer SP2, and a third spacer SP3. The first spacer SP1 may be disposed between the anode electrode 14 and the gate electrode 13. The second spacer SP2 may be disposed between the gate electrode 13 and the focusing electrode 17. The third spacer SP3 may be disposed between the focusing electrode 17 and the anode electrode 14. Each of the first and second spacers SP1 and SP2 may include one of a low-resistance insulator, a medium-resistance insulator, and a high-resistance insulator. For example, each of the first and second spacers SP1 and SP2 may include a medium-resistance insulator 16M.

The third spacer SP3 may include the medium-resistance insulator 16M. A triple point P1 may be provided at a point at which the third spacer SP3, the focusing electrode 17, and vacuum meet each other. Electrons other than the E-beam may be emitted at the triple point P1 under a high voltage condition. The emitted electrons may collide with the third spacer SP3. After the collision, the electrons may move toward the anode electrode 14 through the third spacer SP3.

Embodiments 4 and 5

Figure 4A:
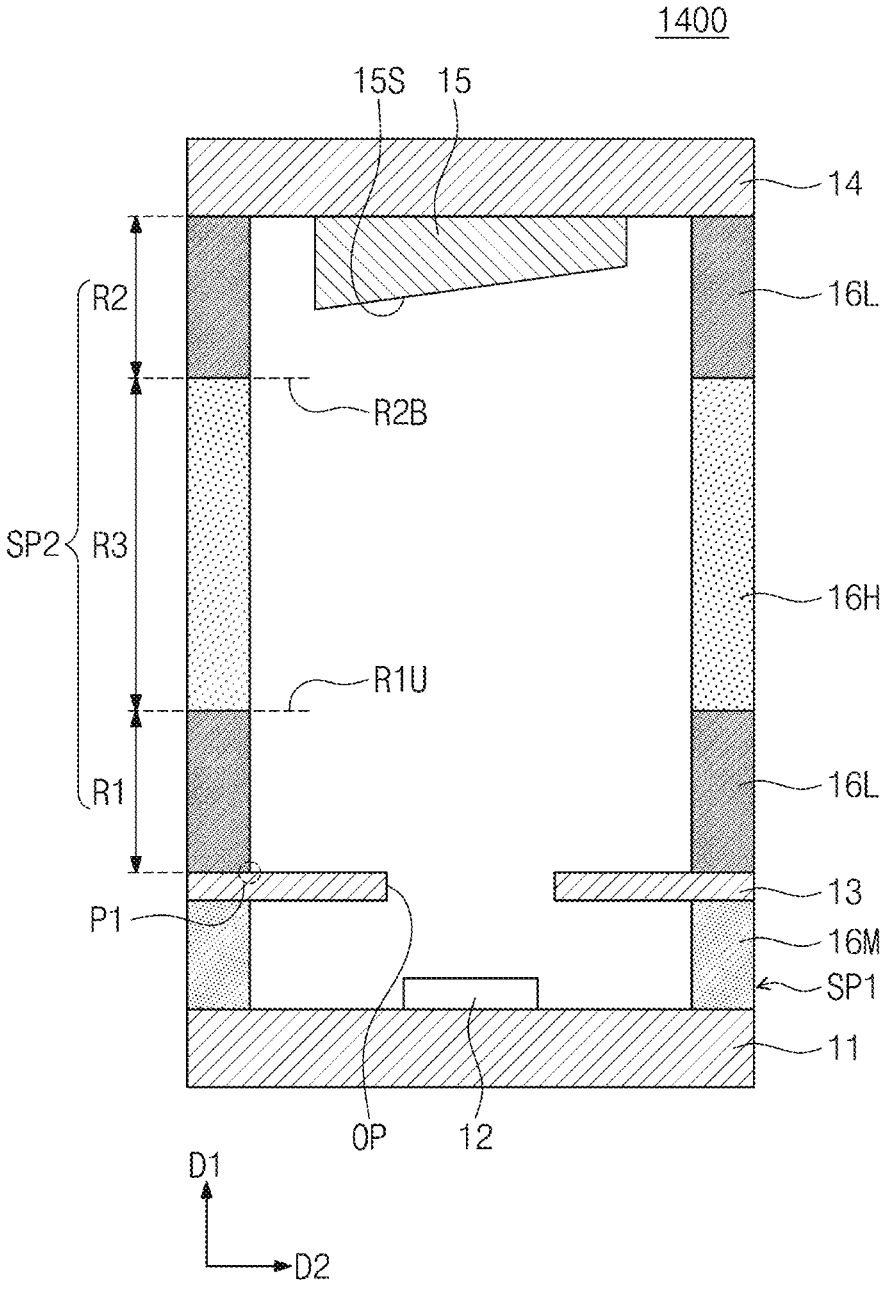
FIG. 4A is a cross-sectional view illustrating an X-ray tube according to Embodiment.
Figure 4B:
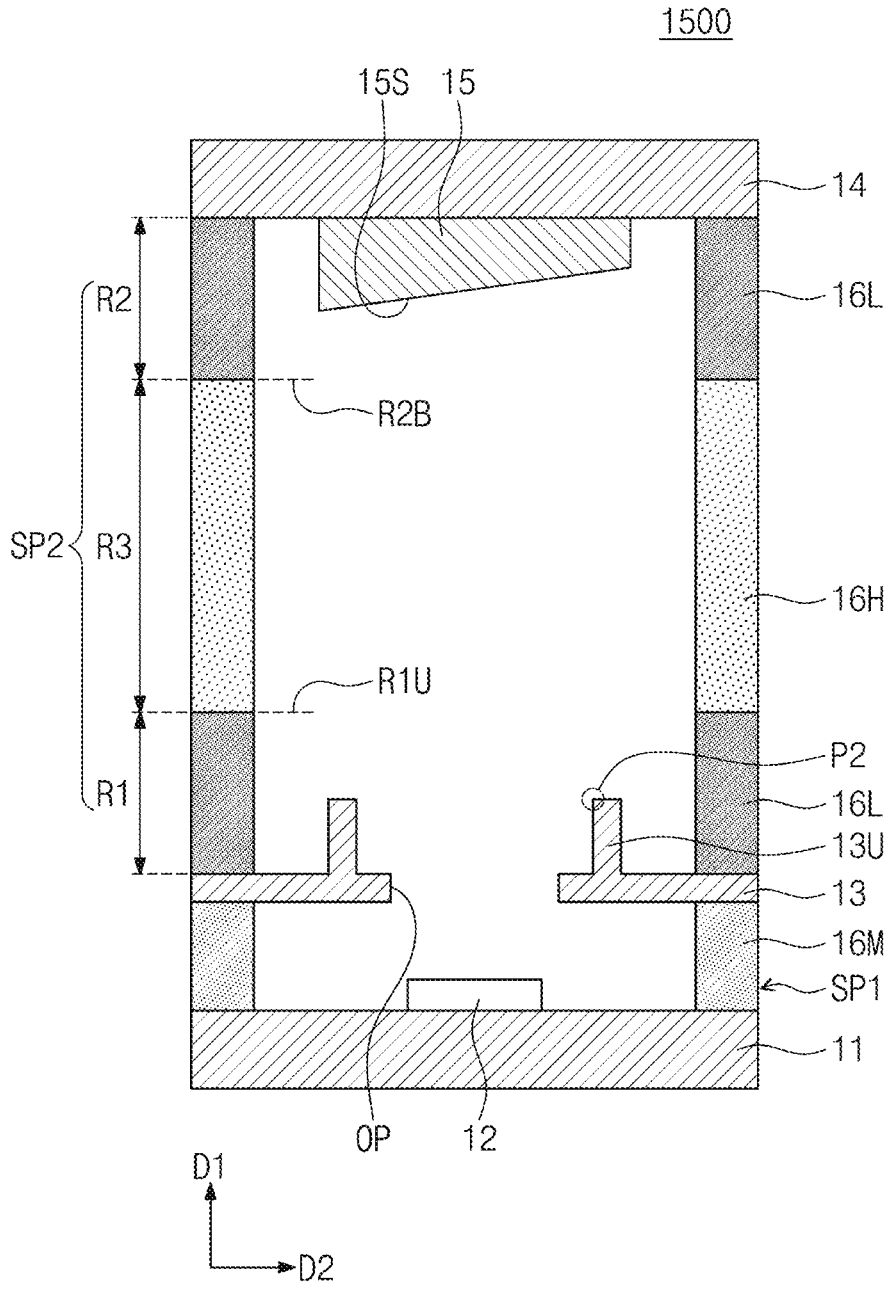
FIG. 4B is a cross-sectional view illustrating an X-ray tube according to Embodiment.

FIG. 4A is a cross-sectional view illustrating an X-ray tube according to Embodiment. FIG. 4B is a cross-sectional view illustrating an X-ray tube according to Embodiment. Since the above-described contents have been described in FIG. 1 except for following contents to be described below, the duplicated contents will be omitted.

Referring to FIG. 4A, an X-ray tube 1300 according to some embodiments may include a second spacer SP2 including a first region R1, a second region R2, and a third region R3, which are arranged in the first direction D1.

The first region R1 may be a portion adjacent to a gate electrode 13, and the second region R2 may be a portion adjacent to an anode electrode 14. The third region R3 may be disposed between the first region R1 and the second region R2.

The first region R1 and the second region R2 may be portions of the second spacer SP2, at which the scattered electrons, the electrons deviated from the normal track, and the electrons emitted from the triple point P1, which are described in FIG. 1A, collide with each other relatively much.

A level of the uppermost portion R1U of the first region R1 may be higher than a level of the uppermost portion of the gate electrode 13. A level of the lowermost portion R2B of the second region R2 may be lower than a level of a bottom surface 15S of a target 15.

Each of the first region R1, the second region R2, and the third region R3 may a first length, a second length, and a third length in the first direction D1. The third length may be greater than each of the first length and the second length.

Each of the first region R1 and the second region R2 may include a low-resistance insulator 16L. The third region R3 may include a high-resistance insulator 16H. Each of the first volume resistivity of the first region R1 and a second volume resistivity of the second region R2 may be less than a third volume resistivity of the third region R3.

Each of the first region R1 and the second region R2 may include an insulator and conductive dopants dispersed in the insulator. Each of the first region R1 and the second region R2 may include conductive dopants contained at a ratio exceeding 3 wt %. The third region R3 may include an insulator and may not substantially include conductive dopants. That is, each of the first region R1 and the second region R2 may selectively include the conductive dopants. According to an embodiment, the third region R3 may include less than about 1 wt % of conductive dopants.

The insulator may include first metal oxide, and the conductive dopants may include second metal oxide. For example, the first metal oxide may include aluminum oxide ($Al_2O_3$), and the second metal oxide may include titanium oxide ($Ti_xO_y$, x=1 to 3, y=1 to 3). The second metal oxide may include at least one of $TiO_2$, $Ti_2O_3$, or TiO.

When all of the first to third regions R3 include titanium oxide ($Ti_xO_y$, x=1 to 3, y=1 to 3), a concentration of $Ti_2O_3$ and/or TiO in each of the first region R1 and the second region R2 is greater than that of $Ti_2O_3$ and/or TiO in the third region R3.

According to the inventive concept, in the scattered electrons, the electrons deviated from the normal track, and the electrons emitted from the triple point P1, which are described in FIG. 1A, a generation of secondary electrons may be reduced even though the electrons collide with the first region R1 and the second region R2 of FIG. 4A. In addition, since the first region R1 includes a low-resistance insulator 16L, emission of electrons at the triple point P1 may be reduced.

As illustrated in FIG. 4B, according to some embodiments, a gate electrode 13 may further include a protrusion 13U. A level of the uppermost portion R1U of the first region R1 may be higher than a level of the uppermost portion of the protrusion 13U. Electrons emitted from an edge P2 of the protrusion 13U may collide relatively much in the first region R1 and/or the second region R2, and even if the electrons collide, the generation of the secondary electrons may be reduced.

The second spacer SP2 according to the inventive concept is formed through the following method. For example, an aluminum oxide ($Al_2O_3$) insulator may be sintered by selectively adding 3% or more of titanium dioxide ($TiO_2$) in the first region R1 and the second region R2. Thereafter, heat treatment may be performed on the first region R1 and the second region R2 under a hydrogen reduction atmosphere.

According to some embodiments, a hydrogen concentration may increase only in portions corresponding to the first region R1 and the second region R2, a heat treatment temperature may increase, or a heat treatment time may increase to promote the reduction reaction of titanium dioxide ($TiO_2$) in the second region R2. If the reduction reaction is promoted, the concentration of $Ti_2O_3$ and/or TiO may increase.

Embodiment 6

Figure 5:
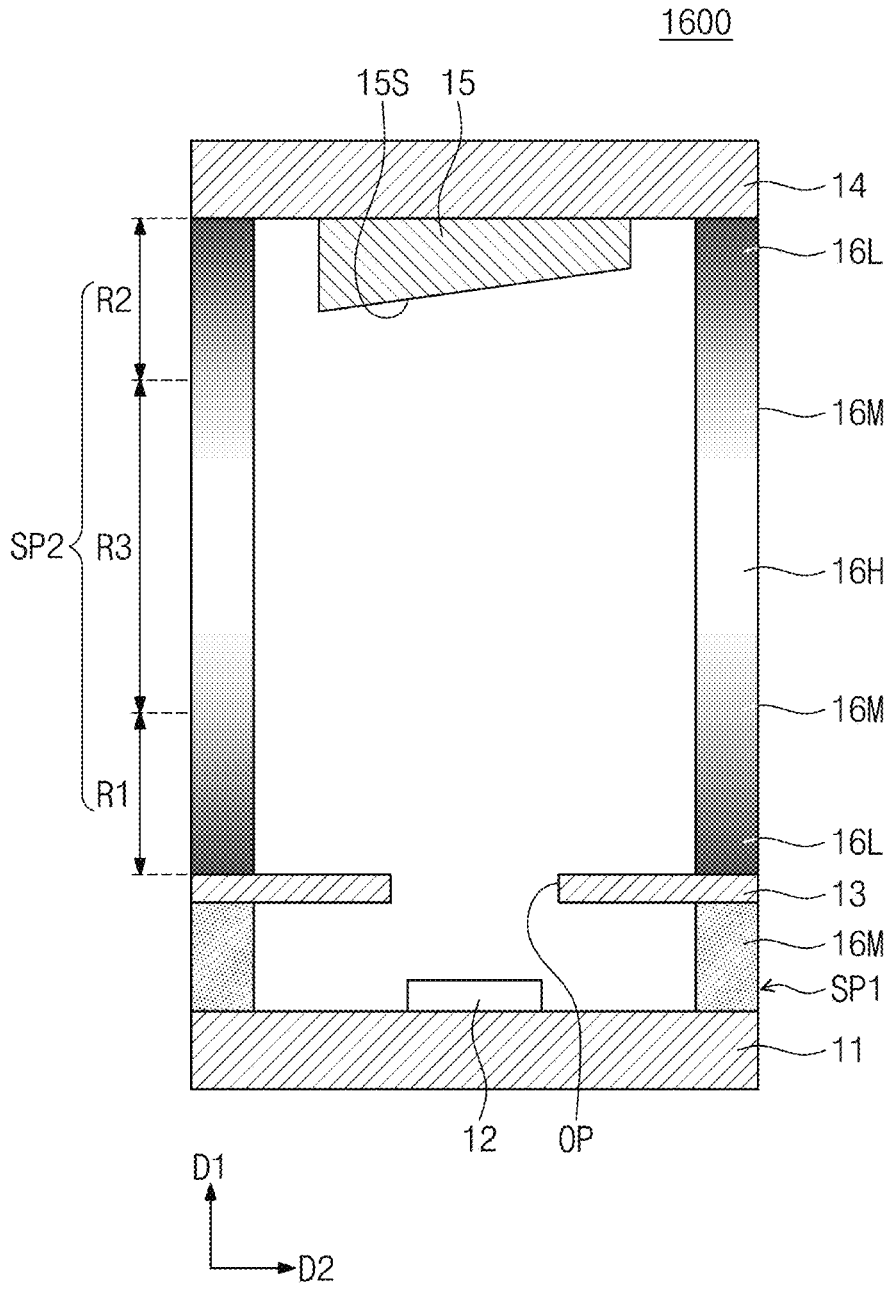
FIG. 5 is a cross-sectional view of an X-ray tube according to Embodiments.

FIG. 5 is a cross-sectional view of an X-ray tube according to Embodiments. Constituents duplicated with those described in FIG. 4A will be omitted.

Referring to FIG. 5, an X-ray tube 1600 according to some embodiments may include a second spacer SP2 in which an amount of conductive dopant is gradually changed in the first direction D1.

Each of first to third regions R1 to R3 may include an insulator and conductive dopants.

The first region R1 may have a resistivity that gradually increases in the first direction D1. The first region R1 may include a low-resistance insulator 16L in a portion adjacent to a gate electrode 13 and a medium-resistance insulator 16M in a portion adjacent to the third region R3.

In the first region R1, a concentration of the conductive dopants may gradually decrease in the first direction D1. That is, the concentration of the conductive dopants in the first region R1 may be largest at the portion adjacent to the gate electrode 13 and smallest at the portion adjacent to the third region R3.

According to some embodiments, a concentration of $Ti_2O_3$ and/or TiO in the first region R1 may be largest at the portion adjacent to the gate electrode 13 and smallest at the portion adjacent to the third region R3.

The second region R2 may have a resistivity that gradually decreases in the first direction D1. The second region R2 may include a medium-resistance insulator 16M at the portion adjacent to the third region R3 and a low-resistance insulator 16L at a portion adjacent to an anode electrode 14.

In the second region R2, a concentration of the conductive dopants may gradually increase in the first direction D1. That is, the concentration of the conductive dopants in the second region R2 may be smallest at the portion adjacent to the third region R3 and largest at the portion adjacent to the anode electrode 14.

According to some embodiments, a concentration of $Ti_2O_3$ and/or TiO in the second region R2 may be largest at the portion adjacent to the anode electrode 14 and smallest at the portion adjacent to the third region R3.

The third region R3 may have a resistivity that gradually decreases and then gradually decreases in the first direction D1. The third region R3 may include a medium-resistance insulator at a portion adjacent to each of the first region R1 and the second region R2 and may include a high-resistance insulator 16H at an intermediate portion.

In the third region R3, a concentration of the conductive dopants may gradually decrease and then gradually increase in the first direction D1. The concentration of conductive dopants in the third region R3 may be largest at each of the portion adjacent to the first region R1 and the second region R2 and may be smallest at the intermediate portion. According to some embodiments, a concentration of $Ti_2O_3$ and/or TiO in the third region R3 may be largest at each of the portion adjacent to the first region R1 and the portion adjacent to the second region R2 and may be smallest at a portion between the above-described two portions.

Table 2 below shows experimental values of a volume resistivity of the second spacer according to an amount of added conductive dopants. Specimens were prepared by adding different amounts of titanium dioxide ($TiO_2$) in about 95 wt % to about 96 wt % aluminum oxide ($Al_2O_3$) and then performing molding and sintering. Thereafter, a volume resistivity of each of the specimens was measured.

TABLE 2

| Amount of added $TiO_2$ | Volume resistivity $R_v$(Ω · cm ) | Test method |
|---|---|---|
| 1 wt % | $4.6 \times 10^{13}$ | ASTM D257 |
| 2 wt % | $6.8 \times 10^{12}$ | ASTM D257 |
| 3 wt % | $7.1 \times 10^{9}$ | ASTM D257 |
| 4 wt % | $6.0 \times 10^{7}$ | ASTM D991 |

Figure 6:
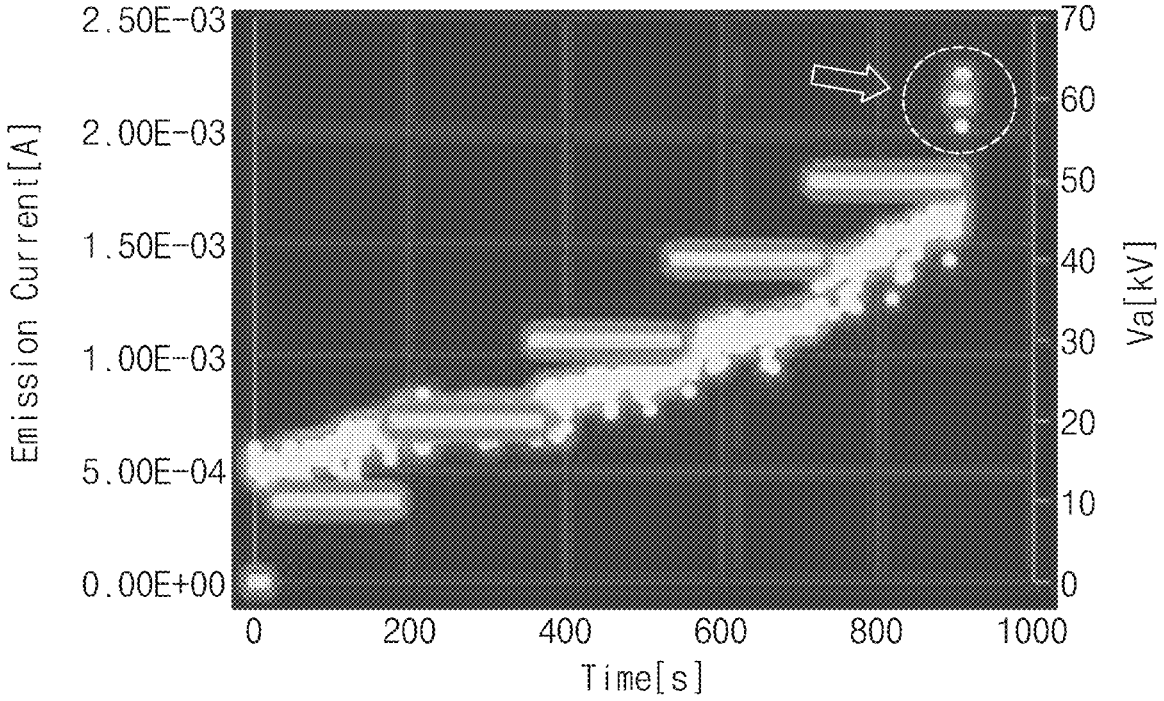
FIG. 6 is a graph illustrating emission current depending on a voltage applied to an X-ray tube according to Comparative Example 1.

FIG. 6 is a graph illustrating emission current depending on a voltage applied to an X-ray tube according to Comparative Example 1. An X-ray tube according to Comparative Example 1 includes a second spacer made of $Al_2O_3$ that does not contain a conductive dopant.

Referring to FIG. 6, current of about 0.5 mA was applied to the X-ray tube, and a voltage gradually increased from about 10 kV to about 60 kV. The applied voltage was maintained for about 3 minutes, and the X-ray tube was driven under conditions of about 0.1 msW and about 1 sP. At the voltage of about 60 kV, as indicated by an arrow, the current rapidly increased to generate arc. In this case, there is a risk of tube damage.

Figure 7:
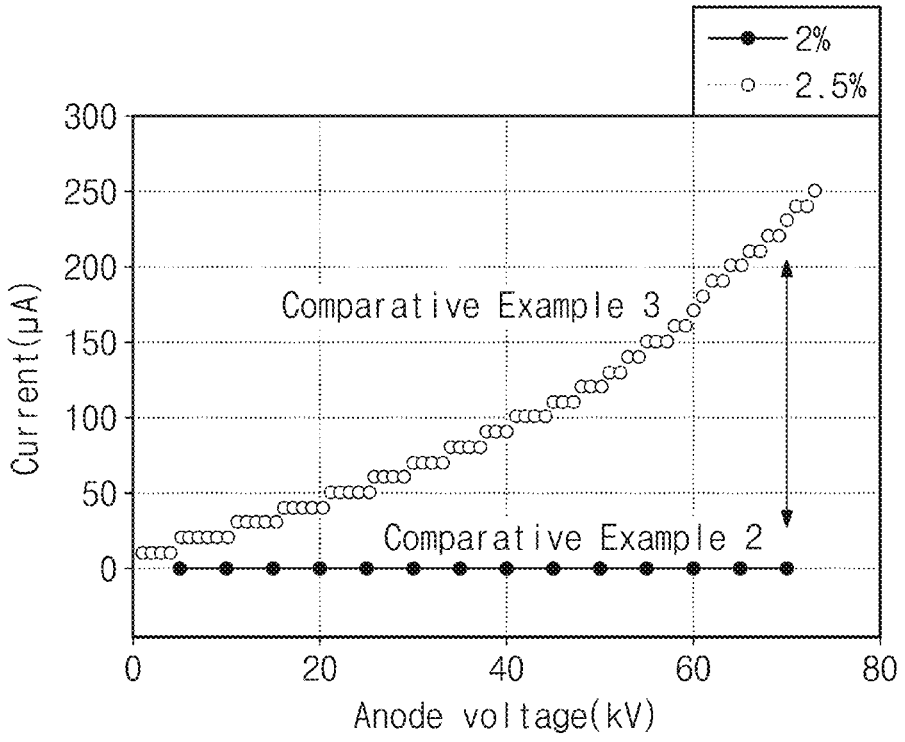
FIG. 7 is a graph illustrating current flowing through a second spacer depending current applied to an X-ray tube according to Comparative Examples 2 and 3.

FIG. 7 is a graph illustrating current flowing through a second spacer depending current applied to an X-ray tube according to Comparative Examples 2 and 3.

Referring to FIG. 7, the X-ray tube according to Comparative Example 2 includes a second spacer to which about 2 wt % of titanium dioxide ($TiO_2$) is added. The X-ray tube according to Comparative Example 3 includes a second spacer to which about 2.5 wt % of titanium dioxide ($TiO_2$) is added. The amount of added titanium dioxide was expressed based on a total weight of the second spacer before the titanium dioxide is added. The second spacer before the addition of titanium dioxide ($TiO_2$) contains about 94 wt % to about 96 wt % of $Al_2O_3$ and about 1 wt % to about 4 wt % of an additive. Referring to FIG. 7, it was observed that in Comparative Example 2, current does not flow almost at the high voltage (about 70 kV), and in Comparative Example 3, an excessive amount of current, for example, about 200 μA of current flows at the high voltage (about 70 kV). It is seen that an amount of added titanium dioxide ($TiO_2$) is preferably more than about 2 wt % and less than about 2.5 wt %.

Referring to FIG. 7 and Table 1, it is seen that the second spacer has a volume resistivity of about $6.8\times10^{12}$ Ω·cm to about $7.1\times10^{9}$ Ω·cm when $TiO_2$ is contained at a ratio ranging about 2 wt % to about 3 wt %. It is seen that the second spacer has a volume resistivity of about $10^9$ Ω·cm or more and less than about $10^{13}$ Ω·cm when titanium dioxide ($TiO_2$) is contained in a ratio of about 1.64 wt % to about 2.44 wt %.

Figure 8A:
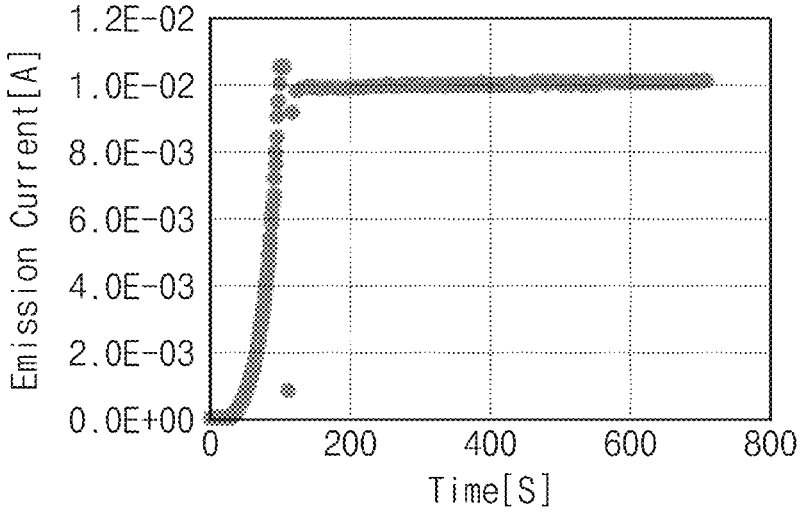
FIGS. 8A an 8B are graphs illustrating emission current applied to an X-ray tube according to Experimental Example 1.

FIGS. 8A an 8B are graphs illustrating current applied to an X-ray tube according to Experimental Examples 1 and 2, respectively.

Figure 8B:
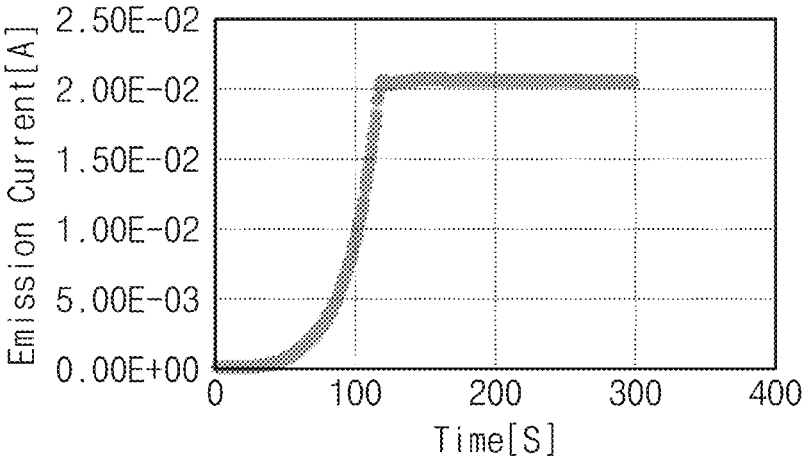

FIGS. 8A an 8B are graphs illustrating emission current applied to an X-ray tube according to Experimental Example 1. In Experimental Example 1, the X-ray tube includes a second spacer to which about 2.15 wt % of titanium dioxide ($TiO_2$) is added. The second spacer before the addition of titanium dioxide ($TiO_2$) contained about 94 wt % to about 96 wt % of $Al_2O_3$ and about 1 wt % to about 4 wt % of an additive. FIG. 8A illustrates emission current when voltage conditions of about 20 mA, about 1 msW, about 100 msP, and about 120 kV are maintained for about 3 minutes in Experimental Example 1. FIG. 8A illustrates emission current when voltage conditions of about 10 mA, about 100 msW, about 6 sP, and about 120 kV are maintained for about 10 minutes in Experimental Example 1. Referring to FIGS. 8A and 8B, it is seen that in Experimental Example 1, the emission current is stably maintained even under the high voltage condition of about 120 kV.

Figure 9:
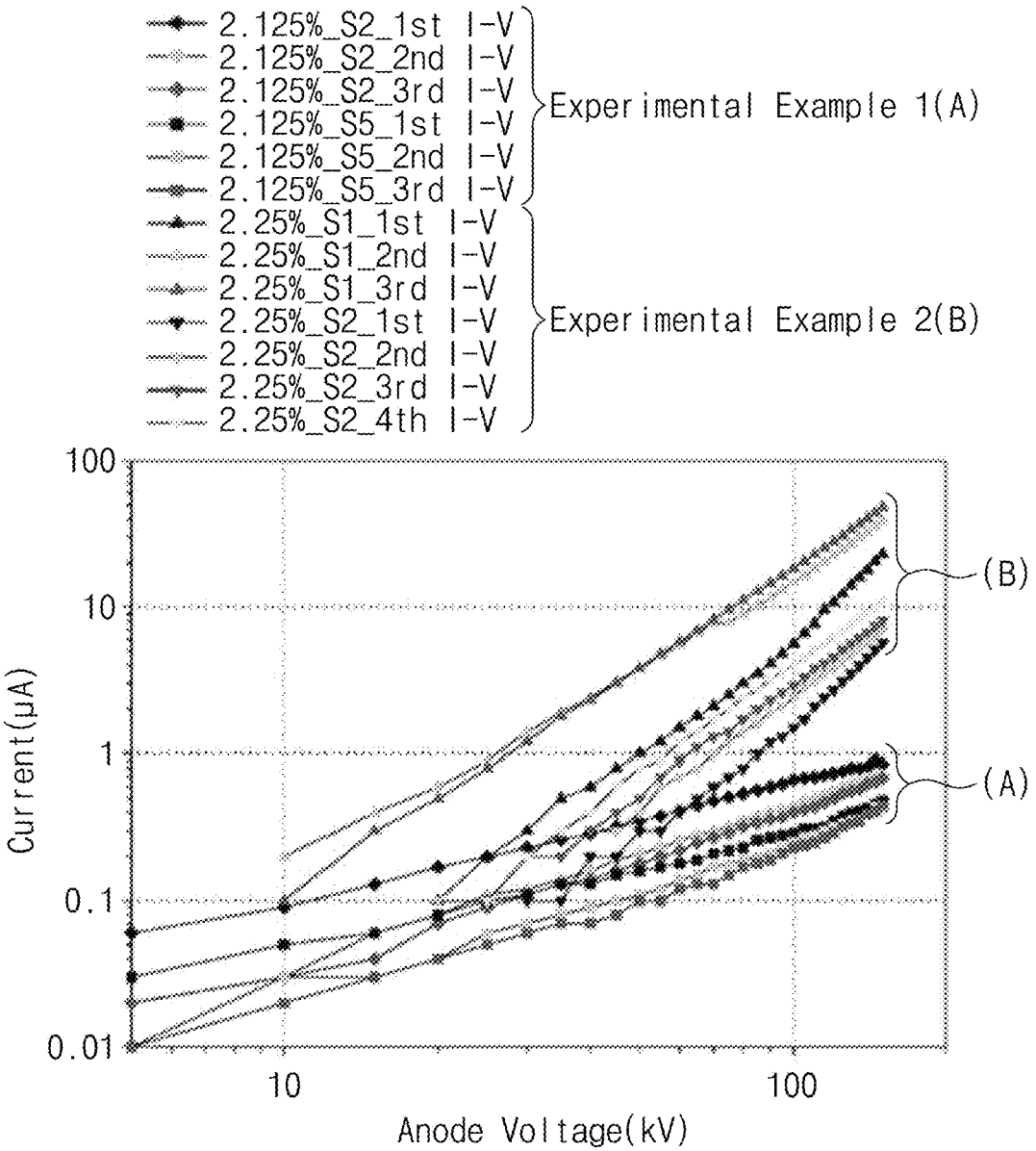
FIG. 9 is a graph illustrating current flowing through a second spacer depending current applied to the X-ray tube according to Experimental Examples 1 and 2.

FIG. 9 is a graph illustrating current flowing through a second spacer depending current applied to the X-ray tube according to Experimental Examples 1 and 2. An X-ray tube according to Experimental Example 1(A) includes a second spacer to which about 2.15 wt % of titanium dioxide ($TiO_2$) is added. An X-ray tube according to Experimental Example 2(B) includes a second spacer to which about 2.25 wt % of titanium dioxide ($TiO_2$) is added.

In both Experimental Examples 1(A) and 2(B), the second spacer before the addition of titanium dioxide ($TiO_2$) contained about 94 wt % to about 96 wt % of $Al_2O_3$ and about 1 wt % to about 4 wt % of an additive.

In Experimental Example 1(A), current of about 0.8 uA was maintained as a result of being maintained at a voltage of 150 kV for about 5 minutes. In Experimental Example 2(B), current increased from 23 uA to about 37 uA as a result of being maintained at a voltage of 150 kV for about 5 minutes. It is seen that in both Experimental Examples 1(A) and 2(B), the second spacer has a certain level of a low conductivity desired in the inventive concept under high voltage conditions.

TABLE 3

| Composition | Component | Mass ratio (wt %) |
|---|---|---|
| Insulator | $Al_2O_3$ | 94.0 |
| Additive | MgO | 0.76 |
| | $SiO_2$ | 2.37 |
| Conductive dopant | $TiO_2$ (other Ti oxides) | 1.77 |
| Impurities | $Fe_2O_3$, $Na_2O$, $K_2O$, $ZrO_2$, ZnO, C, and the like | 1.11 |

Table 3 shows a composition ratio of the second spacer after sintering the second spacer under the hydrogen atmosphere by adding about 2.15 wt % of $TiO_2$ based on a total amount of the second spacer containing about 95 wt % to about 96 wt % of $Al_2O_3$ and about 4 wt % of the additive. Referring to Table 3, when about 2.15 wt % of $TiO_2$ is added, it was observed that a final second spacer contains about 1.77 wt % of titanium oxide. In addition, it was observed that the final second spacer contains about 94 wt % of $Al_2O_3$.

When about 2 wt % of $TiO_2$ is added in the above manner, the final second spacer contains about 1.64 wt % of titanium oxide, and when about 2.5 wt % of $TiO_2$ is added, the final second spacer contains about 2.44 wt % of titanium oxide.

The X-ray tube according to the inventive concept may include the insulator and the conductive dopants doped at the predetermined ratio in the insulator so as to be driven even at the high voltage.

In the above, the embodiments of the inventive concept have been described with reference to the accompanying drawings, but the present disclosure may be implemented in other specific forms without changing the technical spirit or essential features. Therefore, it should be understood that the above-disclosed embodiments are to be considered illustrative and not restrictive.

What is claimed is:

1. An X-ray tube comprising:

a cathode electrode;

an anode electrode vertically spaced apart from the cathode electrode;

an emitter on the cathode electrode;

a gate electrode disposed between the cathode electrode and the anode electrode, the gate electrode comprising an opening at a position corresponding to the emitter; and a spacer provided between the gate electrode and the anode electrode, wherein the spacer comprises a doped region, wherein the doped region is provided with an insulator and conductive dopants doped in the insulator, and wherein the gate electrode is in contact with the doped region.

2. The X-ray tube of claim 1, wherein the spacer has a volume resistivity of about $10^9$ Ω·cm or more and less than about $10^{13}$ Ω·cm.

3. The X-ray tube of claim 1, wherein the insulator comprises aluminum oxide ($Al_2O_3$), and the conductive dopants comprise titanium dioxide ($TiO_2$).

4. The X-ray tube of claim 1, wherein the spacer comprises more than about 1.64 wt % and less than about 2.44 wt % of the conductive dopants.

5. The X-ray tube of claim 1, wherein the insulator comprises first metal oxide having a resistivity of about $10^{13}$ Ω·cm or more, and the conductive dopants comprise second metal oxide having a resistivity of about $10^8$ Ω·cm or less.

6. The X-ray tube of claim 1, wherein a voltage applied to the anode electrode is about 70 kV or more.

7. The X-ray tube of claim 1, wherein the gate electrode further comprises a protrusion extending toward the anode electrode.

8. The X-ray tube of claim 1, wherein the spacer comprises more than about 1.64 wt % and less than about 2.44 wt % of titanium oxide ($Ti_xO_y$, x=1 to 3, y=1 to 3).

9. The X-ray tube of claim 1, wherein the spacer comprises about 93 wt % to about 96 wt % of aluminum oxide.

10. An X-ray tube comprising:

a cathode electrode;

an anode electrode vertically spaced apart from the cathode electrode;

a target disposed on one surface of the anode electrode, wherein the one surface of the anode electrode faces the cathode electrode;

an emitter on the cathode electrode;

a gate electrode disposed between the cathode electrode and the anode electrode, the gate electrode comprising an opening at a position corresponding to the emitter; and a spacer provided between the gate electrode and the anode electrode, wherein the spacer comprises first and second regions between the gate electrode and the anode electrode and a third region between the first and second regions, wherein the first region is in contact with the gate electrode, the second region is adjacent to the anode electrode, each of the first to third regions comprises an insulator, and each of the first and second regions further comprises conductive dopants doped in the insulator.

11. The X-ray tube of claim 10, wherein each of a volume resistivity of the first region and a volume resistivity of the second region is less than a volume resistivity of the third region.

12. The X-ray tube of claim 10, wherein each of the first region and the second region has a volume resistivity of about $10^6$ Ω·cm or more and less than about $10^9$ Ω·cm, and wherein the third region has a volume resistivity of about $10^{13}$ Ω·cm or more.

13. The X-ray tube of claim 10, wherein each of the first region and the second region comprises about 3 wt % or more of conductive dopants.

14. The X-ray tube of claim 10, wherein the third region further comprises conductive dopants in the insulator;

the first region has a concentration of the conductive dopants, which decreases in a first direction from the cathode electrode toward the anode electrode, the second region has a concentration of the conductive dopants, which increases in the first direction, and the third region has a concentration of the conductive dopants, which decreases and then increases in the first direction.

15. The X-ray tube of claim 10, wherein each of a first length of the first region in a first direction from the cathode electrode toward the anode electrode and a second length of the second region in the first direction is less than a third length of the third region in the first direction.

16. The X-ray tube of claim 10, wherein a sum of a volume of the first region and a volume of the second region is less than a volume of the third region.

17. The X-ray tube of claim 10, wherein a level of an uppermost portion of the first region is higher than a level of an uppermost portion of the gate electrode, and a level of a lowermost portion of the second region is lower than a level of a lowermost portion of the anode electrode.

18. The X-ray tube of claim 17, further comprising at least one focusing electrode between the gate electrode and the anode electrode, wherein the level of the uppermost portion of the first region is higher than a level of an uppermost portion of the focusing electrode, and wherein the first region is in contact with the focusing electrode.

* * * * *